US007207378B2

(12) United States Patent
Kroetsch et al.

(10) Patent No.: US 7,207,378 B2
(45) Date of Patent: Apr. 24, 2007

(54) HEAT EXCHANGER DESIGN BASED ON PARTIAL STAIN ENERGY DENSITY RATIO

(75) Inventors: Karl Paul Kroetsch, Williamsville, NY (US); Brian M. Hartman, Lockport, NY (US); Mark R Hammer, Getzville, NY (US)

(73) Assignee: Delphi Technologies, Inc., Troy, MI (US)

( * ) Notice: Subject to any disclaimer, the term of this patent is extended or adjusted under 35 U.S.C. 154(b) by 28 days.

(21) Appl. No.: 11/088,415

(22) Filed: Mar. 24, 2005

(65) Prior Publication Data

US 2006/0213649 A1 Sep. 28, 2006

(51) Int. Cl.
*F28D 1/053* (2006.01)

(52) U.S. Cl. ..... 165/149; 165/153; 165/175

(58) Field of Classification Search ..... 165/148, 165/149, 152, 153, 173, 175
See application file for complete search history.

(56) References Cited

U.S. PATENT DOCUMENTS 3,939,908 A 2/1976 Chartet ..... 165/149
4,534,407 A * 8/1985 Lardner ..... 165/81
4,719,967 A 1/1988 Scarselletta ..... 165/76
5,535,819 A * 7/1996 Matsuura ..... 165/149
5,954,123 A 9/1999 Richardson ..... 165/81
7,036,569 B2 * 5/2006 Kroetsch et al. ..... 165/149
7,059,050 B2 * 6/2006 Calhoun et al. ..... 29/890.052
2002/0020519 A1 * 2/2002 Martins et al. ..... 165/140
2002/0023735 A1 * 2/2002 Uchikawa et al. ..... 165/81
2002/0029869 A1 * 3/2002 Kodumudi et al. ..... 165/81
2002/0084064 A1 * 7/2002 Rhodes et al. ..... 165/149

* cited by examiner

*Primary Examiner*—Teresa J. Walberg
(74) *Attorney, Agent, or Firm*—Patrick M. Griffin

(57) ABSTRACT

A heat exchanger assembly that addresses the thermal cycling problem to increase the durability of the heat exchanger core by fabricating at least the tube next adjacent to each of the reinforcing members with a cross section adjacent each of the headers including a radius having a partial maximum tube strain energy density and fabricating each of the reinforcing members with a connection section adjacent each of the headers having a reinforcement with a partial maximum strain energy density greater than the partial maximum strain energy density of the adjacent tube.

3 Claims, 7 Drawing Sheets

HEAT EXCHANGER DESIGN BASED ON PARTIAL STAIN ENERGY DENSITY RATIO

BACKGROUND OF THE INVENTION

1. Field of the Invention

A method of fabricating a heat exchanger of the type including a plurality of tubes extending between the first and second tank headers with a pair of reinforcing members extending along the opposite sides of the tubes and attached to the tank headers to compensate for the differences in thermal stresses between the reinforcing members and the tubes.

2. Description of the Prior Art

Typical automotive heat exchangers, such as radiators, include a plurality of thin-walled tubes interleaved with corrugated fins enclosed in a core frame. The fins are rigidly attached to the tubes as well as to a pair of frame reinforcing members while the tubes are jointed to a pair of headers. The frame reinforcing members are attached also to the headers. As is well known in the art, coolant passes from one header through the tubing to the other header. As the temperature of the coolant passing through the heat exchanger core increases, the core expands. The frame reinforcing members, however, are not in direct heat contact with the liquid and do not heat at a proportional rate to the heating of the tubing. In use, hot fluid passes through the tubes and a passage of air over the tubes and the fins reduces the temperature of the fluid. However, since the overall temperature of the tubes is relatively high, the tubes thermally expand by a substantial amount with respect to their length when cold. In use, coolant heated by the engine of the associated vehicle enters one tank and flows through the core tubes. The high temperature of the fluid causes heat transfer by conduction and connection to the walls of the tube and on to the fins of the radiator. Air passes over the fins and over the outer periphery of the tubes to cool the fluid therein in a known fashion. Typically the tubes may be of aluminum or brass both of which have relatively high coefficients of expansion. Thus the hot water causes the tubes to tend to expand thus increasing the separation between the two headers. However, use of a conventional reinforcing member would substantially maintain the spacing between the two headers, because the reinforcing members are not subjected to the same high temperatures as the tubes. The result of the tendency of the tubes to grow in length, while the reinforcing members grow less, is to place high stresses on the region where the tubes are secured to the tank header wall. As a result of the expansion and contraction of the tubing, the reinforcing members induce thermal stress in the tube-to-header joints during the thermal cycling of the heat exchanger.

To overcome this thermal cycling problem, it is known in the art to relieve the thermally-induced stress by an expansion joint system, as disclosed in U.S. Pat. No. 3,939,908 to Chartet. The expansion of the reinforcing member of the radiator has also been mitigated by saw cutting the reinforcing members following brazing of the core and prior to placing the heat exchanger core into service, as disclosed in U.S. Pat. No. 5,954,123 to Richardson. However, the saw cutting operation is difficult to automate, is excessively loud, and produces a tremendous amount of metal fines resulting in increased downtime and increased maintenance of the saw.

Other methods have been proposed to relieve the thermally-induced stress in the heat exchanger core without the need for saw cutting the side supports. For example, U.S. Pat. No. 4,719,967 proposes the sue of a "T-shaped" or "I-shaped" slot or piercing stamped into the core reinforcement prior to forming the reinforcement into a channel member. After brazing the core assembly, the reinforcement is fractured at the perforation to allow for expansion of the core during thermal cycling of the heat exchanger. The use of such a "T-shaped" or "I-shaped" perforation may be difficult to maintain since the perforation may fill up with filler metal such as cladding or solder during the brazing of the core.

SUMMARY OF THE INVENTION AND ADVANTAGES

The invention provides a heat exchanger design criterion that addresses the thermal cycling problem to increase the durability of a heat exchanger core of the type described in the prior art section. Such a heat exchanger core includes tubes extending between a first tank header and a second tank header and reinforcing members extending between the tank header and reinforcing members extending between the header tanks. At least one tube adjacent each of the reinforcing members has a radiused cross section adjacent each of the headers and each of the reinforcing members has a connection section adjacent each of the headers. The assembly and its method of fabrication is distinguished by fabricating at least one tube adjacent each of the reinforcing members with a cross section adjacent each of the headers including a radius having a partial tube strain energy density, and fabricating each of the reinforcing members with a connection section adjacent each of the headers having a partial reinforcing strain energy density greater than the tube strain energy density of the adjacent tube.

Accordingly, no matter the configuration of the reinforcing member, stress is reduced by utilizing a tube having a radius with a partial strain energy density therein that has a predetermined relationship with the partial strain energy density in the reinforcing member.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
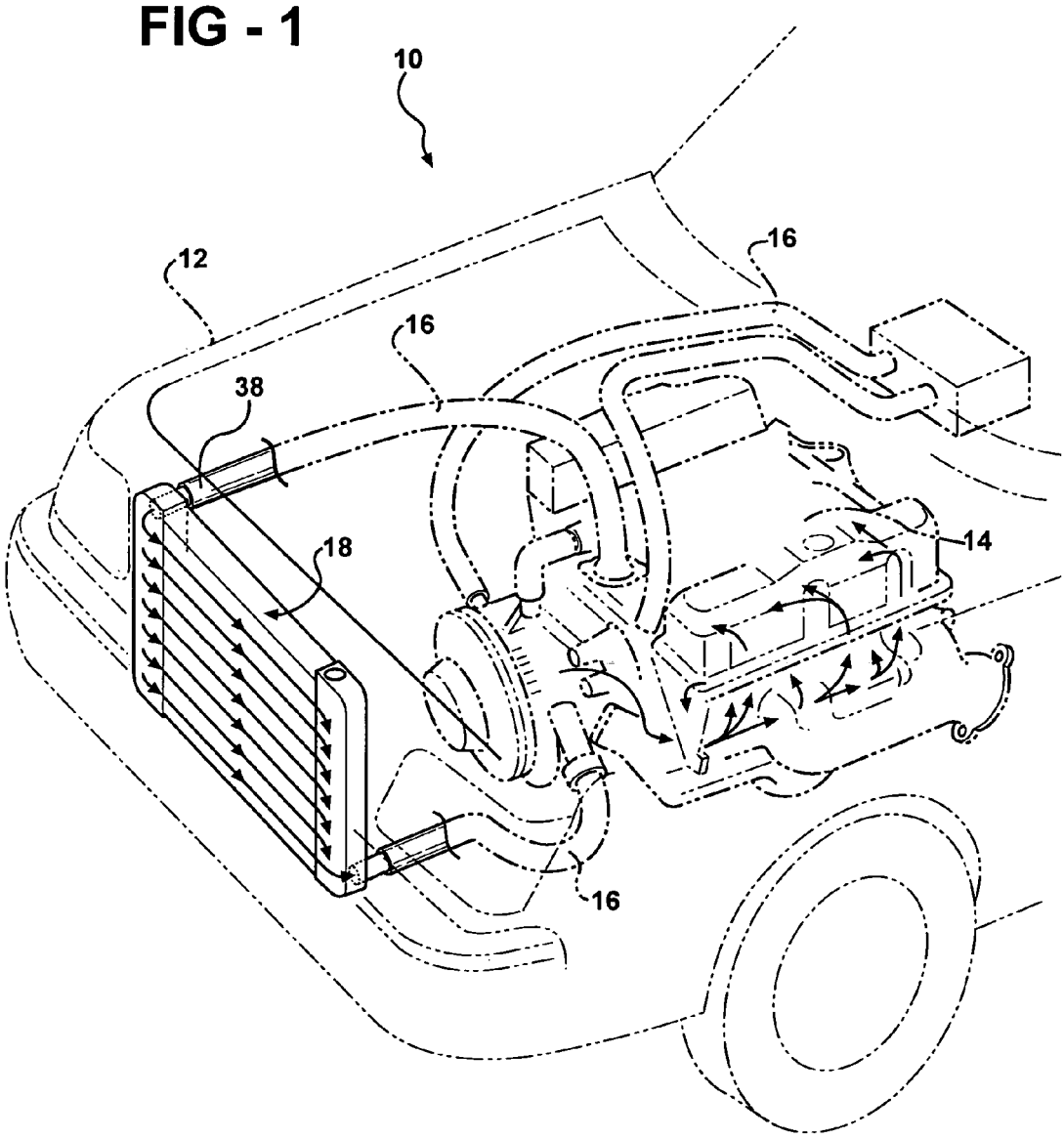
FIG. 1 is a perspective view of a cooling system for an automotive vehicle with the automotive vehicle shown in phantom.

Referring to FIG. 1, a cooling system is generally shown at 10 in a vehicle 12 shown in phantom. The cooling system 10 circulates a cooling fluid from an engine 14 through a hose 16 to a heat exchanger assembly 18 or radiator generally indicated at.

Figure 2:
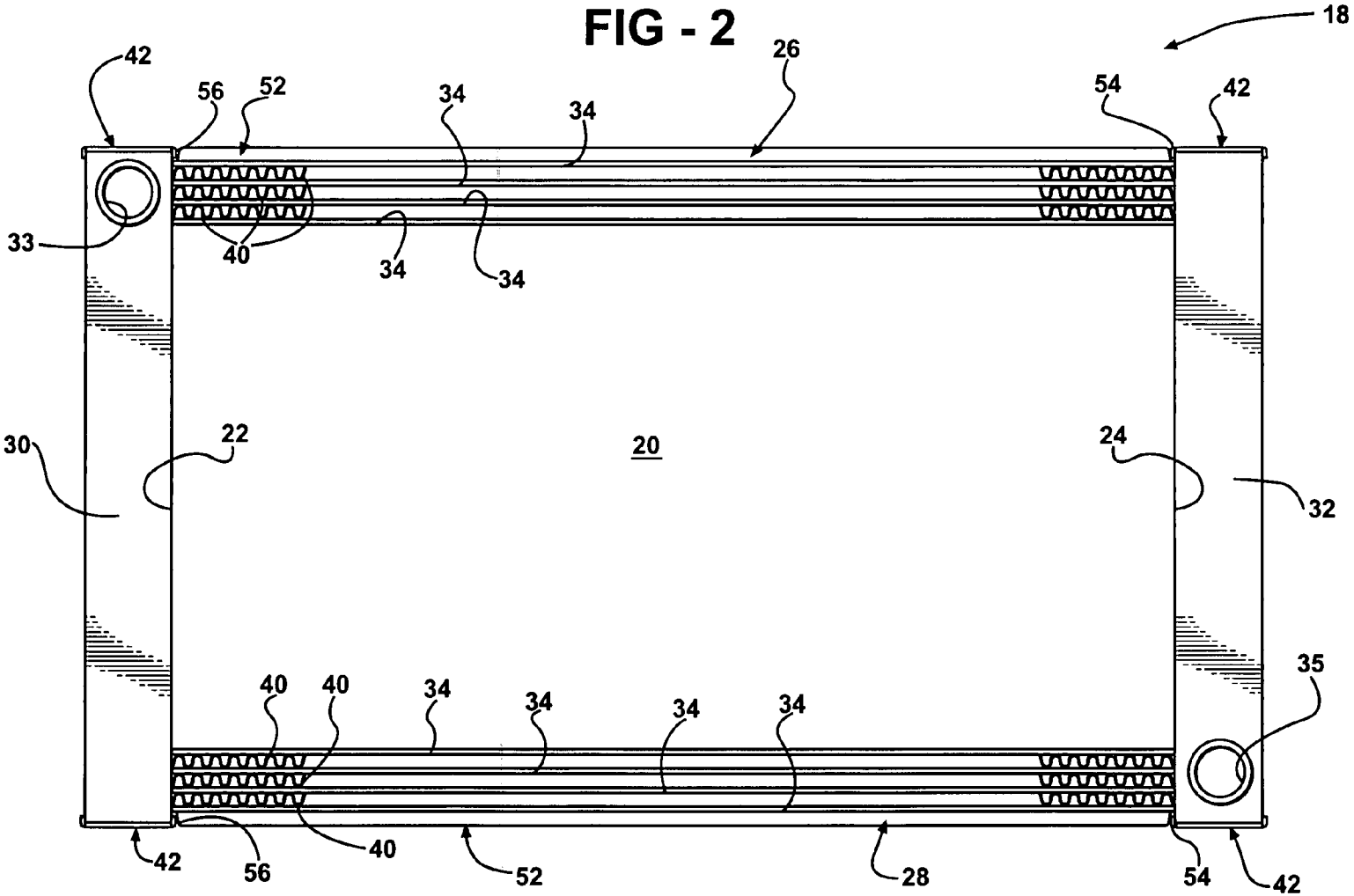
FIG. 2 is a front view of an heat exchanger assembly constructed in accordance with the subject invention.

As shown in FIG. 2, the heat exchanger assembly 18 of the present invention includes a core 20 having a first end 22 and an opposite second end 24 and a first side 26 and a second side 28 opposite to the first side 26 for cooling the fluid flowing internally by heat exchange with air pulled through the core 20 by a fan (not shown). The core 20 is disposed or extends between a first tank header 30 and a second tank header 32. The first tank header 30 is disposed at the first end 22 of the core 20 and the second tank 32 is disposed at the second end 24 of the core 20. A plurality of tubes 34, through which the fluid normally flows horizontally, are disposed to extend between the first and second tanks 30, 32, as is well known in the art. The tubes 34 are inserted into elongated oval-like slots 36 defined in the respective first and second tanks 30, 32, for the fluid flow therebetween. Each tube 34 has a cross section including parallel flats interconnected by an oppositely disposed pair of radii with the flat zones perpendicular to the long direction of the tank headers with the flat zones perpendicular to the long direction of the tank headers, i.e, each tube 34 has a cross section including a radius. The first and second tanks 30, 32, also include an inlet 33 and an outlet 35 to define fluid connections 38 (FIG. 1) to convey the fluid into the first tank 30 and out of the second tank 32. The core 20 includes a plurality of corrugated fins 40 shown in FIG. 2. Each fin 40 is disposed between adjacent tubes 34 as is well known in the art. However, for simplicity, the fins 40 are not shown in the remaining Figures.

Figure 3:
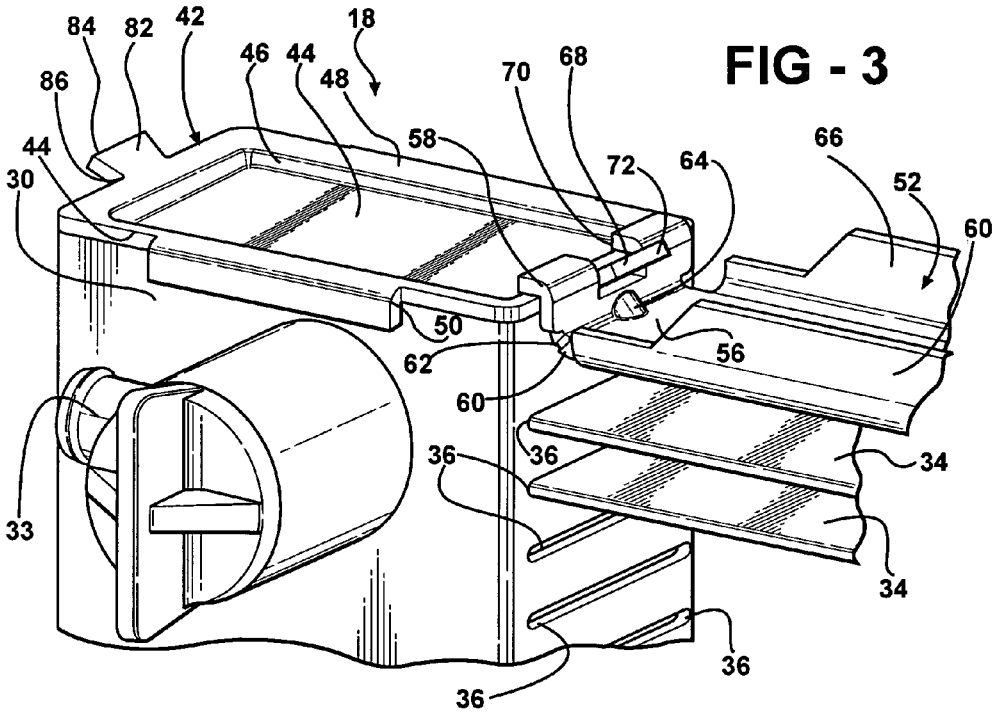
FIG. 3 is a fragmentary perspective view showing the upper left corner without fins of the heat exchanger assembly showing a header tank and a tank cap having a plurality of tabs extending from the tank caps but without showing the fins between the tubes.

The heat exchanger assembly 18 includes a plurality of caps 42, each generally indicated at. The caps 42 are configured for closing the opposite openings of the first and second tanks 30, 32 at opposite terminal ends 22, 24 of the core 20. As illustrated in FIG. 3, each cap 42 is disposed in engagement within the openings of the first and second tanks 30, 32. More specifically, in order to facilitate the closure of the openings of the first and second tanks 30, 32, each cap 42 has a recess or a dished configuration with a bottom 44 and sidewalls 46 below a rim 48 for disposition in the first and second tanks 30, 32. The sidewalls 46 engage the interior of the tanks 30, 32 and the rim 48 engages the opening of each tank 30, 32 for being brazed thereto. A pair of rectangular flanges 50 are integral with and extend outwardly in opposite directions from the rim 48 of each cap 42. The rectangular flanges 50 are clinched or bent over and downward into the exterior of each of the first and second tanks 30, 32. The core 20, the tanks 30, 32, the fins 40, the tubes 34, and the caps 42 consist of one homogenous material, namely a metal such as aluminum.

As is customary in the art, a pair of reinforcing members 52, extend along the opposite sides 26, 28 of the core 20 and are attached as by brazing to the headers tanks 30 and 32. Each reinforcing member 52 presents a first extremity 54 and a second extremity 56 with each of the extremities 54, 56 presenting a first bend 58 and a second bend 60 defining a pair of reversed interconnected bends 58, 60 having an S-shaped configuration to engage the rim 48 of the adjacent cap 42. Each of the bends 58, 60 of the extremities 54, 56 are more narrow in width than the cap 42. A notch 62 defines a connection section or a bending joint at each side 26, 28 of the extremities 54, 56 between the second bend 60 at the intersection of the S-shaped configuration and the remainder of the reinforcing member 52. Each notch 62 acts to reduce stress applied to the core 20 reinforcing member 52 in a connection section thereby providing a strain energy density control point or area. A gusset 64 is integral with and extends across the second bend 60 to provide structural support to each of the extremities 54, 56. Each of the reinforcing members 52 includes a pair of spaced and parallel reinforcing webs 66 extending upwardly and terminating short of the extremities 54, 56. The reinforcing webs 66 extend upwardly along the sides 26, 28 of a flat bar. Each reinforcing member 52 consists of one homogenous material, namely a metal such as aluminum.

Figure 4:
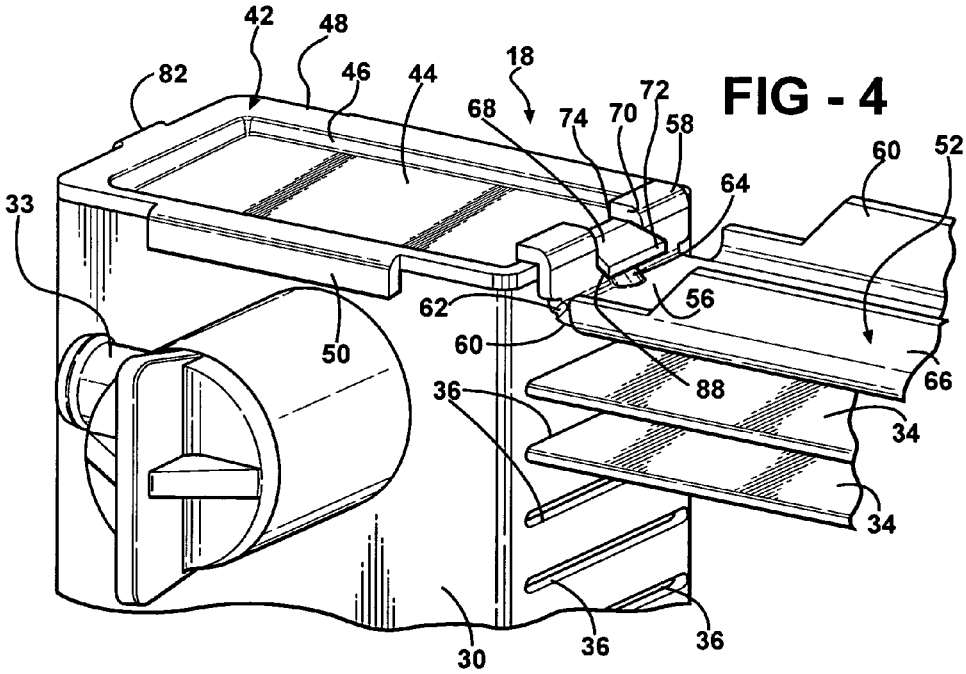
FIG. 4 is a fragmentary perspective view as shown in FIG. 3 showing the tabs in the bend and final connecting position.

Referring to FIG. 4, the a mechanical connection 38 for connecting each of the caps 42 to the adjacent extremities 54, 56 of the reinforcing members 52 has tabs 68 integral with and sloping outwardly and bent downwardly into an opening or cut-out portion 70 defined in each extremity 54, 56 of the core 20 reinforcing member 52. Each tab 68 has a head 72 and a neck 74 more narrow in width than the head 72. The neck 74 and the head 72 are interconnected by outwardly tapered sides 26, 28 to define a dovetailed configuration of the tab 68. The cut-out portion 70 presents a rectangular configuration having a width complementary to the width of the neck 74 to receive the tab 68. The cut-out portion 70 is just wide enough to receive the neck 74 but is smaller than the head 72 to retain the tab 68 in the cut-out portion 70 for connecting or holding the core 20 reinforcing members 52 to the caps 42 as the heat exchanger assembly 18 is brazed.

Figure 5:
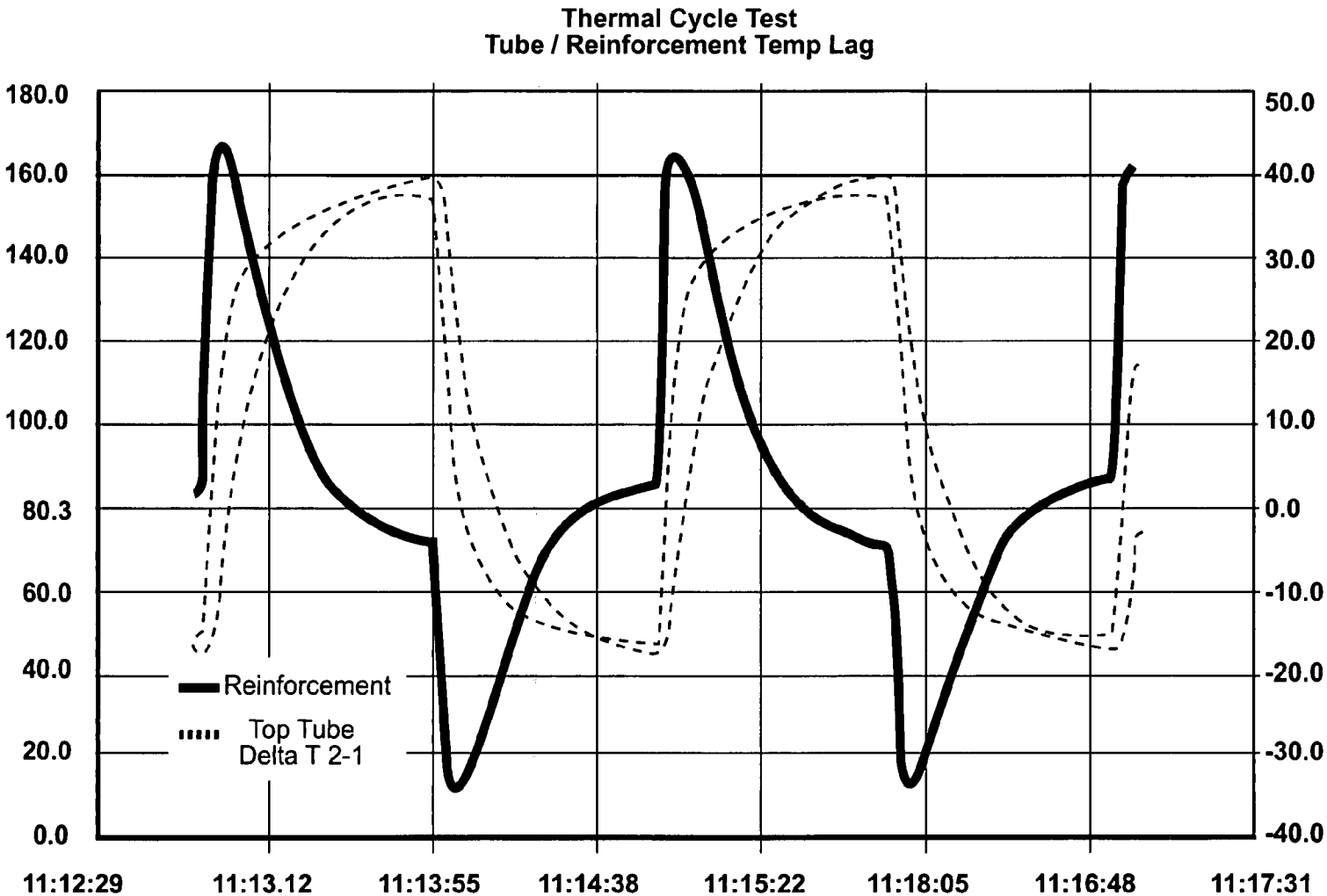
FIG. 5 is a chart showing the temperature lag of the reinforcement members behind the tubes.
Figure 8:
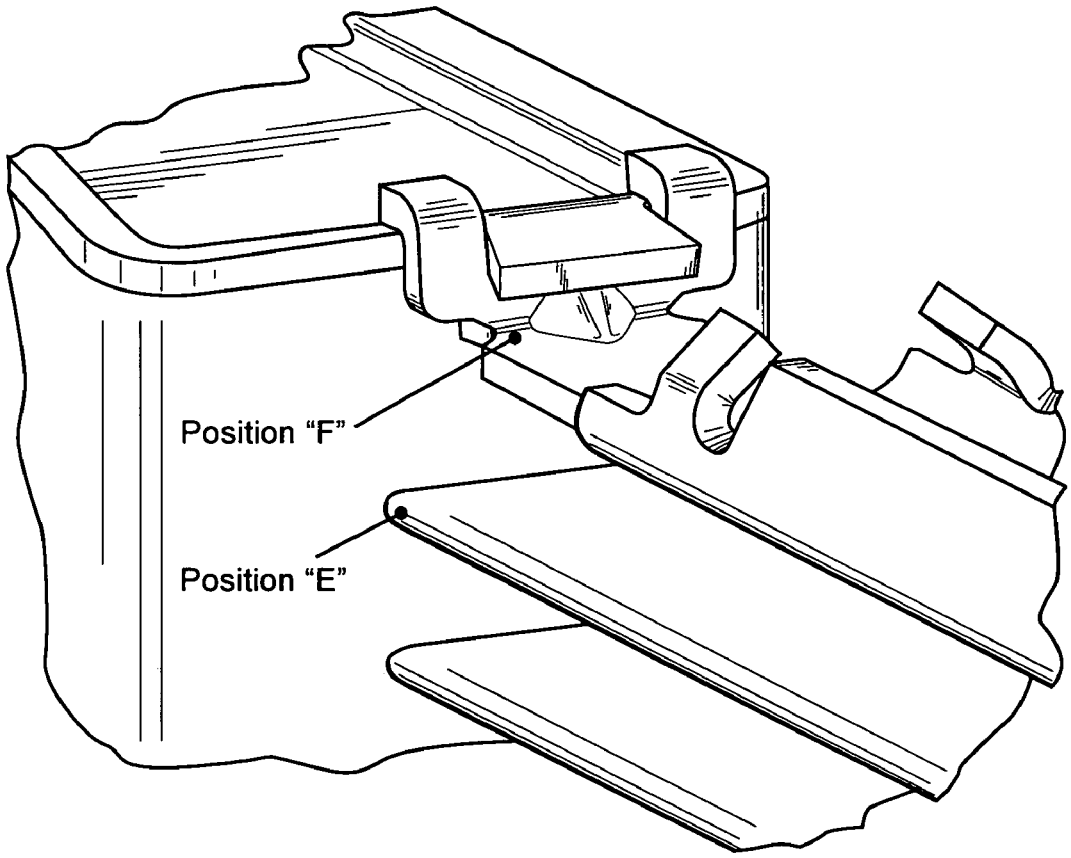
FIG. 8 is fragmentary perspective view showing the positions at which maximum strains are measured.

The finite element analysis of various structures has yielded a significant discovery to maximize the thermal cycle durability of aluminum heat exchangers. Such is accomplished by fabricating at least the tube 34 next adjacent to each of the reinforcing members 52 with a cross section adjacent each of the headers 30, 32 including a radius having a partial tube strain energy density at position E as shown in FIG. 8, and fabricating each of the reinforcing members 52 with a connection section adjacent each of the headers having a partial strain energy density greater than the partial strain energy density of the adjacent tube 34, as shown at position F in FIG. 8. Again, the strain energy density is defined as strain energy per unit volume or yield stress times total strain, which includes strains induced by the forces that originate from differential thermal expansion among the components of the heat exchanger. As illustrated in FIG. 5, the expansion and contraction of the reinforcing member (the reinforcement) lags behind the expansion and contraction of the tube 34 next adjacent the reinforcing member 52. The instantaneous temperature difference between the first tube 34 next adjacent the reinforcing member 52 is also illustrated in FIG. 5. The invention is illustrated in FIG. 6 wherein the reinforcing member partial maximum strain energy density must always be greater than the tube partial maximum strain energy density.

The definition of "mechanical strain" is the measureable strain resulting from forces that originate from differential thermal expansion among the components of the radiator. The definition of "partial strain energy density" is the quantity obtained by multiplying the mechanical strain at any point in the heat exchanger by the published yield stress of the material that composes the point.

Figure 6:
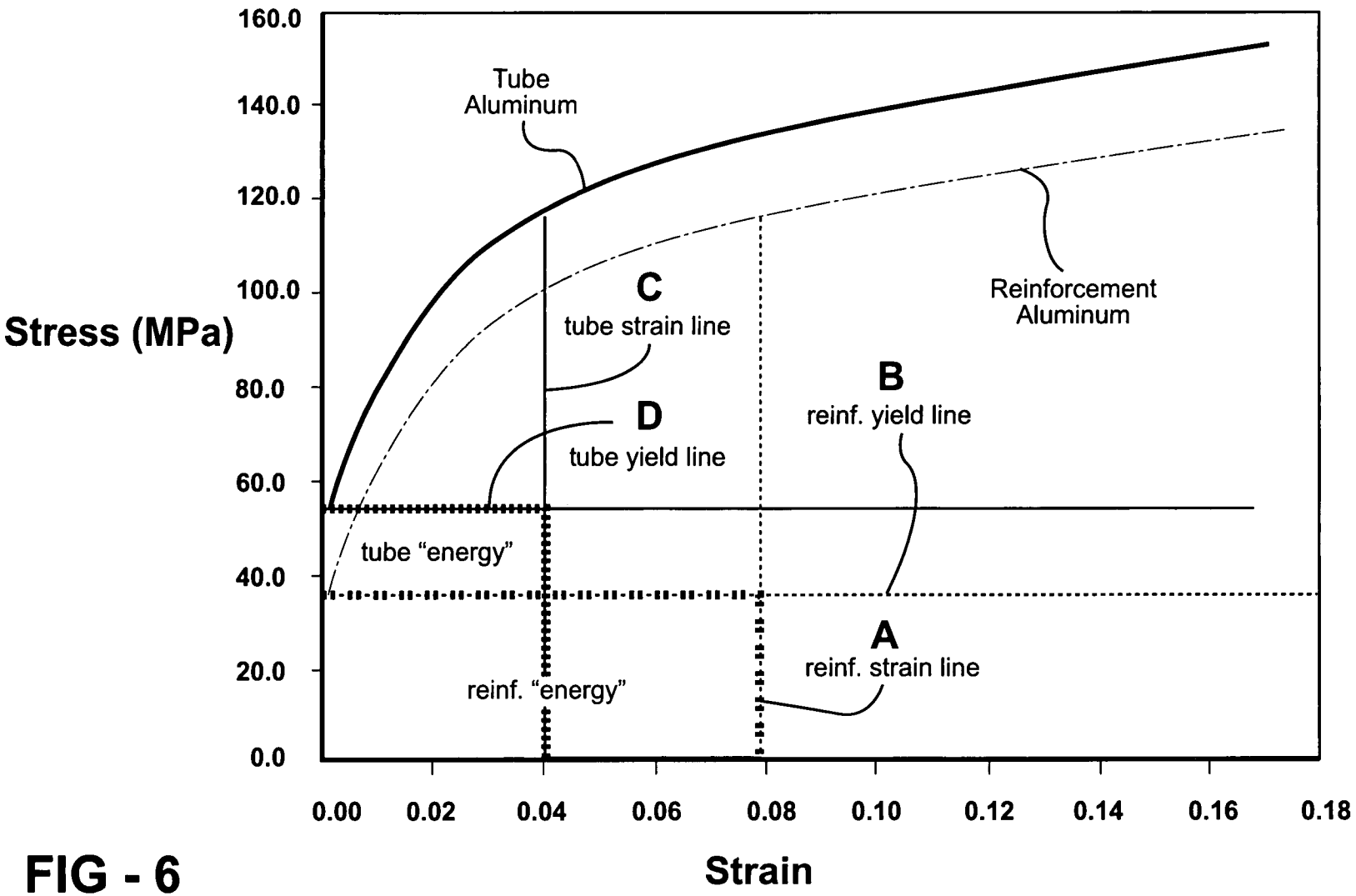
FIG. 6 is a chart showing the desired relative strain between the reinforcement members and the tubes.
Figure 7:
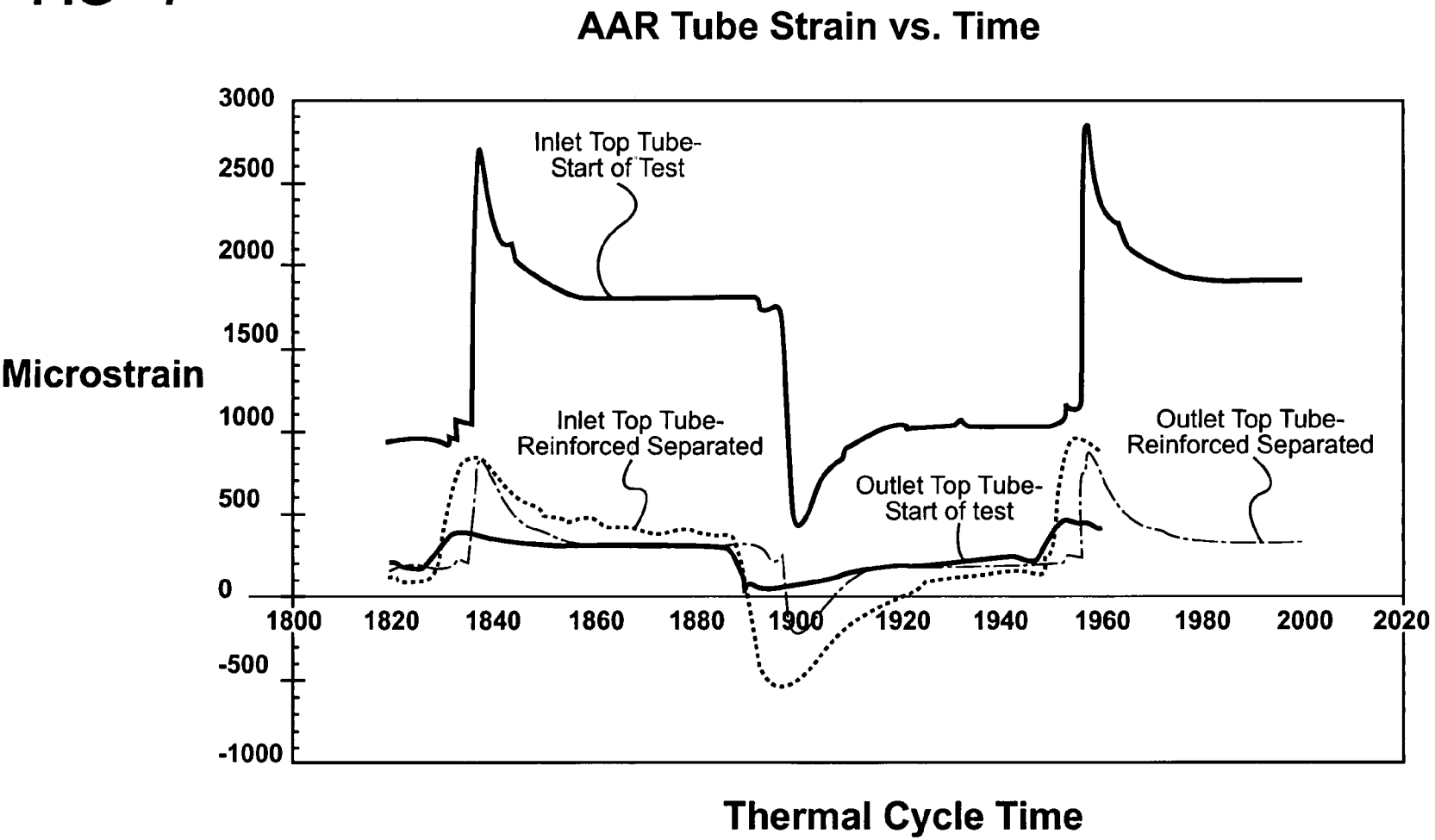
FIG. 7 is a chart comparing tube strain before and after reinforcement member separation.

FIG. 6 graphically depicts strain energy density for a point on the reinforcement ($E_r$) as the area of the rectangle formed by (spaced and paired vertical bars separated by dashes forming the rectangle in the lower left hand corner) the reinforcement strain line (A) for that point and the reinforcement material yield stress line (B). Similarly, we can define the partial strain energy density for a point on the tube ($E_t$) as the area of the rectangle formed by (spaced solid rectangles forming two sides of left hand lower corner) the tube strain line (C) for that point and the tube material yield stress line (D).

Accordingly, the problem of tube fatigue is addressed by utilizing a tube having a partial strain energy density anywhere therein (Et) and a reinforcement having a partial strain energy density anywhere therein (Er) satisfying the following relationship:

$$3.0>Er/Et>1.0.$$

In order to achieve acceptable thermal cycle, the relationship Er>Et must be satisfied. As the ratio of Er/Et approaches 3.0, the heat exchanger thermal cycle durability will be optimized.

Obviously, many modifications and variations of the present invention are possible in light of the above teachings. The invention may be practiced otherwise than as specifically described within the scope of the appended claims.

What is claimed is:

1. A heat exchanger assembly comprising:

a core comprising a series of tubes and fins interposed between the tubes, each tube having ends, a first tank header and a second tank header arranged with said core such that each tube comprises one end in fluid tight communication with the first header and an opposite end in fluid tight communication with the second header, a reinforcing member comprising a connection section attached to the first tank header and including a bend, wherein during thermal cycling of the heat exchanger assembly the connection section exhibits a partial strain energy density based upon a maximum mechanical strain of the bend, at least one tube being adjacent said reinforcing member and having a cross section adjacent the first tank header that includes a radius section, said radius section having a partial strain energy density based upon a maximum mechanical strain of the tube at said radius section during said thermal cycling, characterized in that said partial strain energy density of the connection section is greater than the partial strain energy density of said radius section.

2. An assembly as set forth in claim 1 wherein the bend includes at least one notch.

3. An assembly as set forth in claim 1 wherein said cross section of the adjacent tube includes flats interconnected by radius sections.

* * * * *